United States Patent [19]

Suliga

[11] Patent Number: 4,870,818

[45] Date of Patent: Oct. 3, 1989

[54] FUEL NOZZLE GUIDE STRUCTURE AND RETAINER FOR A GAS TURBINE ENGINE

[75] Inventor: William G. Suliga, Rocky Hill, Conn.

[73] Assignee: United Technologies Corporation, Hartford, Conn.

[21] Appl. No.: 853,599

[22] Filed: Apr. 18, 1986

[51] Int. Cl.[4] ..... F07C 1/00

[52] U.S. Cl. ..... 60/740; 60/756

[58] Field of Search ..... 60/39.31, 39.32, 740, 60/748, 752, 756

[56] References Cited

U.S. PATENT DOCUMENTS

| | | | |
|---|---|---|---|
| 3,273,343 | 9/1966 | Cretella | 60/748 |
| 3,385,055 | 5/1968 | Koblish et al. | 60/748 |
| 3,403,510 | 10/1968 | Lauck | 60/748 |
| 3,901,446 | 8/1975 | Detreikis, Jr. et al. | 60/748 |
| 4,322,945 | 4/1982 | Peterson et al. | 60/39.32 |
| 4,365,470 | 12/1982 | Matthews et al. | 60/39.32 |
| 4,454,711 | 6/1984 | Ben-Porat | 60/39.32 |

*Primary Examiner*—Louis J. Casaregola
*Assistant Examiner*—T. S. Thorpe
*Attorney, Agent, or Firm*—Troxell K. Snyder

[57] ABSTRACT

A nozzle guide structure (10) is provided for receiving a fuel nozzle (34) in an opening (30) in a planar bulkhead (28) of a combustion chamber (12). The guide structure (10) includes an inner bushing (44), a transverse heat shield (46), and an annular retainer (52) disposed opposite the heat shield (46) with respect to the bulkhead (28). Flow openings (62) disposed in the retainer (52) admit cooling air (64) into an annular gap (50) formed between the bushing (44) and the bulkhead (28). the cooling air (64) subsequently flow between the bulkhead (28) and the heat shield (46) to provide cooling thereto.

7 Claims, 2 Drawing Sheets

FUEL NOZZLE GUIDE STRUCTURE AND RETAINER FOR A GAS TURBINE ENGINE

FIELD OF THE INVENTION

The present invention relates to a fuel nozzle guide for a gas turbine engine, and more particularly, to a fuel nozzle guide structure retained in the wall of a gas turbine engine combustor.

BACKGROUND

Liquid fuel is typically supplied to the combustor section of a gas turbine engine by a plurality of fuel nozzles discharging atomized liquid fuel into a combustion chamber or the like. Prior art arrangements are disclosed in U.S. Pat. No. 4,365,470 to Matthews et al, U.S. Pat. No. 4,322,945 to Peterson et al, and U.S. Pat. No. 3,273,343 to Cretella.

In typical gas turbine engines, the fuel nozzle extends through an opening in the combustion chamber, discharging a spray of liquid fuel into the chamber interior wherein it is mixed with combustion air and reacted at high temperature. In order to permit convenient servicing of individual fuel nozzles, the nozzles and the combustion chamber are typically supported independently within the engine, with the fuel nozzles additionally being located in a region of relatively cool temperature in order to prevent overheating of the fuel flowing to the nozzle discharge.

Such design features, in combination with the high temperature of the combustion reaction, result in differential thermal expansion between the combustor chamber and the fuel nozzles. Such expansion is accommodated through the use of a movable guide structure disposed in the wall of the combustion chamber which receives the fuel nozzle. These guide structures, as shown in the referenced patent documents, may serve a dual function by not only controlling the amount of air admitted into the combustion chamber adjacent the fuel nozzle, but additionally protecting the nearby chamber wall from the high temperature combustion reaction.

Prior art nozzle guide structures are typically complex, having airflow paths defined therein and being engaged with the combustion chamber walls by a variety of sliding clip or channel arrangements. These complicated structures can be difficult to assemble and repair both in the production shop and in the field. Moreover, prior art nozzle guide structures have tended to concentrate bearing forces on limited areas of the combustor wall leading to premature wearing and reduced service life for the guide structure and the chamber wall.

What is needed is a nozzle guide structure which is both simple in itself, simple in its engagement with the wall or bulkhead of the combustion chamber, and which provides the necessary thermal protection to the combustion chamber wall adjacent the fuel nozzle.

SUMMARY OF THE INVENTION

It is an object of the present invention to provide a long-wearing, air cooled fuel nozzle guide structure, receivable in an opening in a planar bulkhead of a high temperature combustor for accommodating differential thermal expansion between the combustor and an independently supported fuel nozzle.

It is further an object of the present invention to retain the guide structure within the bulkhead by an annular retainer having a plurality of flow openings therewithin for admitting a flow of cooling air directly into an annular gap formed between the guide structure and the bulkhead.

It is still further an object of the present invention to provide a heat shield, cooled by airflow paths in fluid communication with the annular gap and slidable with the guide structure for thermally protecting the bulkhead from the high temperature combustion reaction.

According to the present invention, a nozzle guide structure is provided with a bushing for receiving the fuel nozzle closely therewithin. A transverse heat shield is secured about one end of the bushing and maintained spaced apart from a substantially planar bulkhead through which the bushing extends. An annular retainer is secured to the bushing on the opposite side of the bulkhead and includes a flat flange portion for slidably contacting the planar bulkhead. A plurality of flow openings in the annular retainer admit a flow of cooling air into an annular gap formed between the bushing and the bulkhead with at least a portion of the cooling air thence flowing transversely between the bulkhead and the heat shield via flow paths defined therebetween.

More specifically, the guide structure according to the present invention includes a plurality of standoffs, integral with the heat shield, for spacing the shield and the bulkhead. The annular retainer also more specifically includes an attachment ring closely fitting about the bushing and secured thereto by an annular weld.

The guide structure according to the present invention thus exhibits reduced wear as compared to prior art structures by defining a large contact area between the annular retainer and the bulkhead. Additionally, the guide structure according to the present invention avoids complex internal cooling gas flow passages by routing the cooling air between the bushing and the bulkhead via the annular gap and admits cooling air into the gap directly through cooling holes disposed in the annular retainer thus ensuring an adequate gas flow.

DETAILED DESCRIPTION OF THE PREFERRED EMBODIMENT

Figure 1:
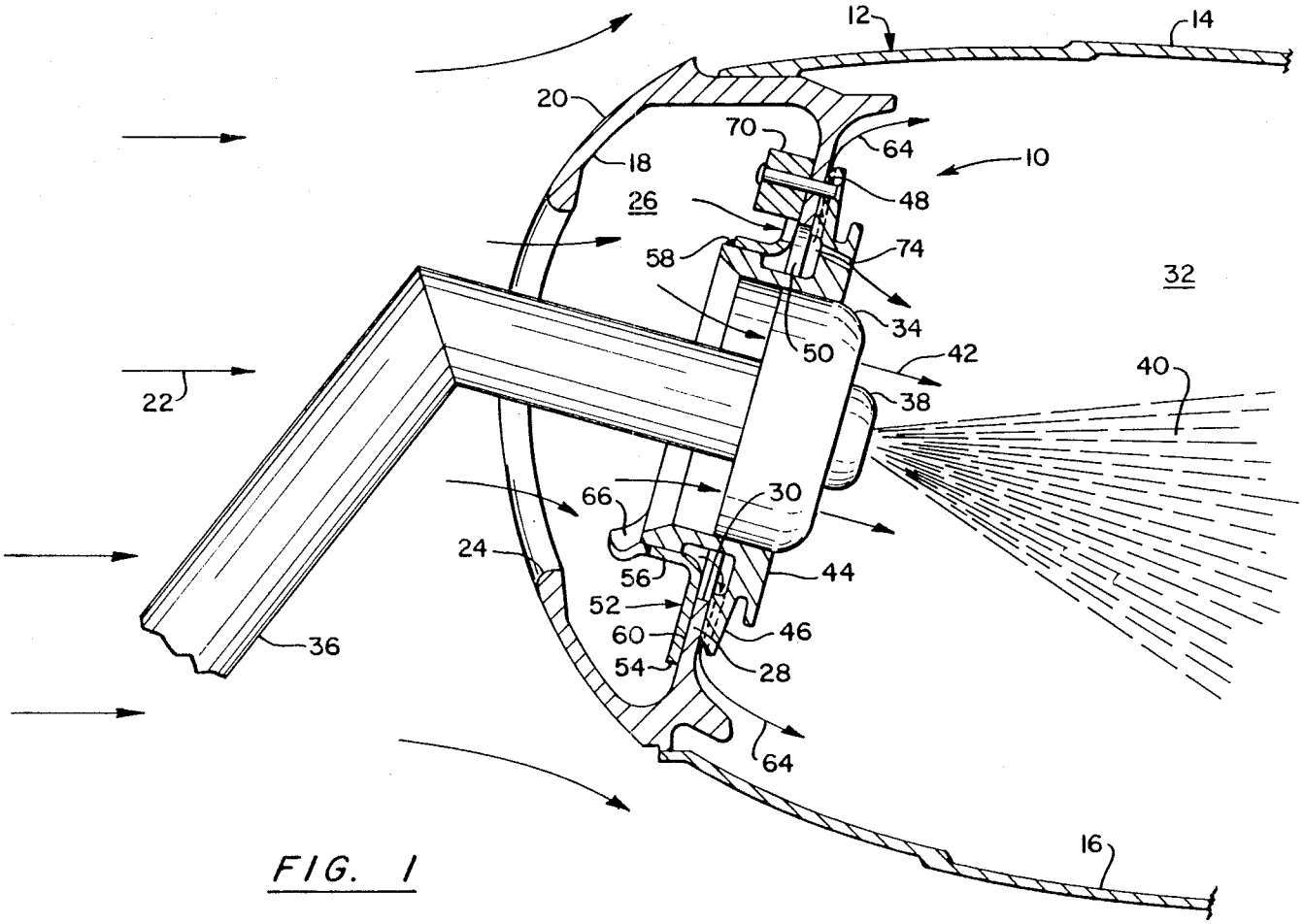
FIG. 1 shows a cross sectional view of the nozzle guide structure according to the present invention.

Referring to the drawing Figures, and in particular to FIG. 1 thereof, a nozzle guide structure 10 according to the present invention is shown in an axial cross section taken at the forward end of an annular combustion chamber 12 of an axial flow gas turbine engine. The combustion chamber 12 includes inner and outer coaxial liners 14, 16, and, in this arrangement, a head member 18 disposed at the forward end thereof.

The head 18 itself includes a convex domed surface 20 for diverting an annularly flowing stream 22 of compressed air radially inward and outward of the combustion chamber 12. An opening 24 in the domed surface 20 admits a portion of the annularly flowing air stream 22 into the interior plenum region 26 of the head 18. The plenum 26 is further defined by a planar bulkhead 28 having a circular opening 30 disposed therein. As shown in FIG. 1, the nozzle guide structure 10 fits within the opening 30 int he bulkhead 28.

The liners 12, 14, the bulkhead 28, and the nozzle guide structure 10 define the combustion chamber 12 having an interior region 32 wherein a mixture of fuel and air is reacted to form high temperature combustion products for driving the downstream turbine section (not shown) of the gas turbine engine.

Fuel and primary combustion air enter the combustion region 32 through the fuel nozzle 34. The nozzle 34 is cantilevered by a fuel supply conduit 36 secured to the outer engine casing (not shown). The supplied fuel is discharged from an atomizer tip 38 as a fine droplet spray 40. Combustion air 42 enters the upstream side of the nozzle 34 from the plenum region 26 and is discharged adjacent the fuel spray 40 as shown in FIG. 1.

The high temperature, 2800 F. (1540 C.) or higher, which occurs within the combustion region 32 causes the combustion chamber components 14, 16, 18 to experience significant thermal transients and thermally induced differential expansion as compared to the nozzle support structure 36. Such differential expansion results in both longitudinal and transverse displacement of the fuel nozzle 34 relative to the bulkhead 28 of the combustor head 18. It is the function of the nozzle guide structure 10 to accommodate such differential displacement without altering the critical fuel-air ratio provided by the nozzle guide 34, as well as to withstand the effects of the high temperature combustion reaction occurring in the combustion region 32.

The guide structure 10 according to the present invention accomplishes these and other objects by providing a nozzle guide bushing 44 disposed closely, but slidably, about the fuel nozzle 34 and extending longitudinally through the opening 30 in the bulkhead 28. A transversely extending, annular heat shield 46 is disposed about the bushing 44 on the combustion reaction facing side of the parallel bulkhead 28, and is maintained spaced therefrom by a plurality of integral discrete standoffs 48 extending toward the bulkhead 28 and in slidable contact therewith.

The bushing 44 has an outer diameter less than that of the opening 30, thus defining an annular gap 50 therebetween. The annular gap 50 is in fluid communication with the interior of the combustion chamber 32 via a plurality of flow paths defined between the individual standoffs 48, the bulkhead 28, and the heat shield 46.

The bushing 44 is retained longitudinally relative to the bulkhead 28 by annular retainer 52 having a transversely extending, flattened flange portion 54 and an inner attachment ring portion 56 secured to the bushing 44 by an annular weld 58 or the like.

The flattened flange portion 54 slidably contacts 60 the parallel bulkhead 28, having by virtue of its flattened configuration a large contact area therewith. It will be appreciated by those skilled in the art of bearing surfaces that this large contact area reduces the contact force per unit area for a given overall longitudinal force on the guide structure 10 which in turn reduces the wear rate of the individual sliding components 54, 28.

Figure 2:
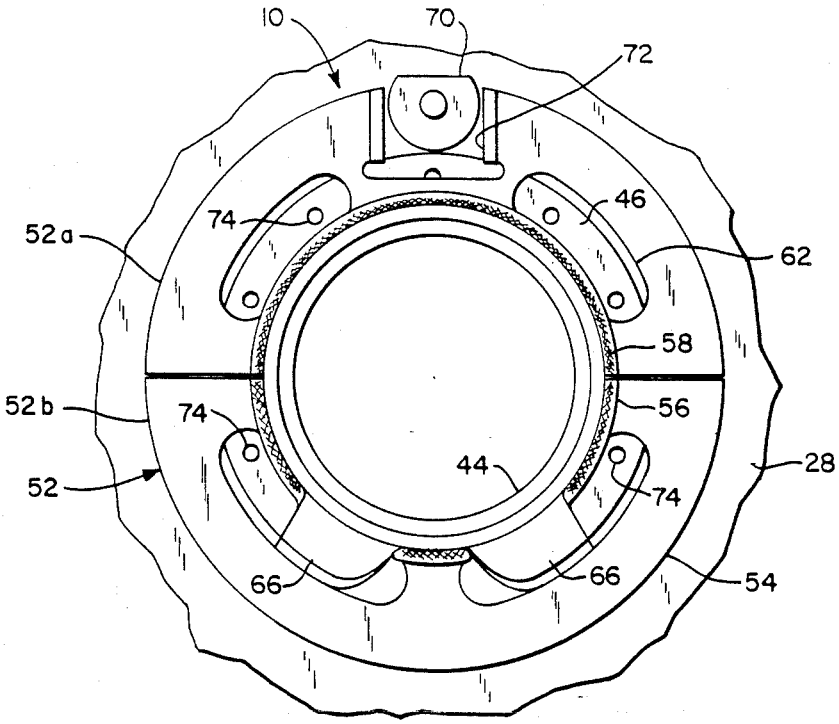
FIG. 2 shows a view of the annular retainer as indicated in FIG. 1.

Referring additionally to FIG. 2, wherein a longitudinal view of the guide structure 10 appears (the fuel nozzle structure 34, 38, 36 has been deleted for clarity), the means for admitting a flow of cooling air directly between the plenum 26 and the gap 50 is shown in the form of a plurality of flow openings 62 distributed annularly within the retainer 52. The openings 62 are located adjacent the annular gap 50 and provide a direct flow route for the cooling air.

The nozzle guide structure 10 according to the present invention is cooled during engine operation by a portion of the annularly flowing cooling air stream 22 diverted into the plenum 26, flowing directly into the annular gap 50 through the flow slots 62 in the retainer 52, and subsequently flowing transversely between the bulkhead 28 and the heat shield 46 among the standoffs 48. It may also be preferable, depending on the particular circumstances, to include one or more secondary air supply openings 74 in the bushing 44 for directing a flow of air from the gap 50 into the combustion chamber 12 adjacent the nozzle 34. The bulkhead 28 and nozzle guide structure 10 are thus protected from the effects of the high temperature fuel-air reaction, with the transversely flowing cooling air subsequently entering the combustion chamber interior 32 at the outer edge of the heat shield 46, thereby minimizing the impact of the additional air 64 on the combustion reaction.

By admitting the cooling air 64 directly into the annular gap 50, the retainer ring 52 and nozzle guide assembly 10 according to the present invention achieves a higher rate of air flow than prior art nozzle guides wherein the cooling air flow traverses a more tortuous route prior to encountering the guide heat shield. Additionally, by providing a nozzle guide structure 10 which is able to interface directly with a planar bulkhead 28, the present invention reduces both the complexity of the individual components as well as the labor required to assemble the guide structure 10 within the combustor head 18.

Other features of the nozzle guide structure which provide significant benefit when utilized in a gas turbine engine environment include the provision of sloped tabs 66 integral with the attachment ring 56 and extending outwardly in a sloping orientation. Such tabs serve as a means for aligning the guide structure 10 during insertion of the nozzle 34, especially for those nozzles disposed in the upper vertical portion of the annular combustor head 18.

Figure 3:
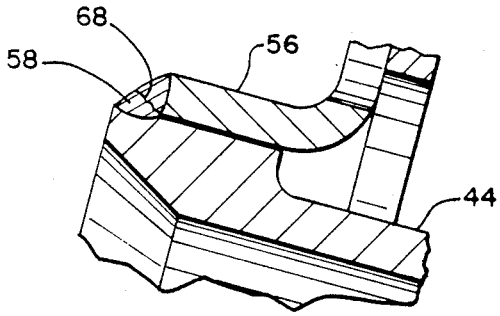
FIG. 3 shows a detailed view of the annular weld between the retainer and the bushing.

It is a further feature of the nozzle guide 10 according to the present invention to provide a fail-safe means for preventing separation and loss of the bushing 44 upon failure of the securing means 58. This is accomplished by closely fitting the attachment ring 56 about the bushing 44 and orienting the weld 58 outward of the bushing 44 as shown in detail in FIG. 3. Weld 58 thus forms an outward-facing fillet between the attachment ring 56 and the bushing 44.

Analysis of the attachment indicates that should a cracking failure occur therein, the crack will be oriented at a 45° angle with respect to the bushing surface as indicated by a crack line 68 shown in the weld 58. As will be appreciated from an inspection of FIG. 3, the crack 68, while if propagated completely about the circumference of the bushing 44 will result in the complete separation of the bushing 44 and the retainer ring 56, has not compromised the longitudinal retention of the bushing 44 within the bulkhead 28. The portions of the weld 58 attached to the bushing 44 still provide longitudinal interference with the close fitting attachment ring 56, preventing detachment and loss of the bushing 44 into the downstream components of the gas turbine engine (not shown). The outward facing fillet weld 58 thus provides an inherently fail-safe securing means which is both simple and inexpensive.

One final feature of the guide structure 10 is the incorporation of an antirotation means with the annular retainer 52 for preventing relative rotation between the bulkhead 28 and the guide structure 10. FIGS. 1 and 2 show the antirotation means as comprising a post 70 secured to the upstream side of the bulkhead 28 and being received within a transverse slot 72 disposed in the flattened flange portion 54 of the retainer 52. The post, secured by riveting, welding, etc. to the bulkhead 28 and the slot 72 permit transverse movement of the nozzle guide structure 10 relative to the bulkhead 28 while restraining rotational movement therebetween.

The antirotation means is necessary should it be desirable to provide as asymmetric heat shield 46 which must be maintained in at least an approximate rotational orientation within the combustion chamber 32. The post 70 and slot 72 shown in the preferred embodiment of the present invention in FIGS. 1 and 2 provide a simple means for accomplishing the antirotation function, one which does not significantly increase the complexity of the individual guide structure components or the assembly procedure.

For arrangements such as shown in FIG. 1 wherein the guide structure 10 is assembled within a combustor head 18 prior to insertion of the fuel nozzle 34, it has been found advantageous to divide the retainer 52 into two semi-circular halves 52a, 52b as shown most clearly in FIG. 2. The halves are thus more easily inserted through the opening 24 in the domed surface 20, being subsequently welded into an integral annular member 52 and secured to the bushing 44.

The nozzle guide structure according to the present invention is thus well suited to achieve the objects and functions as set forth hereinabove. It will further be appreciated that, although disclosed in terms of a preferred embodiment, the present invention encompasses other alternative, equivalent configurations and is limited only by the claims presented hereinbelow.

I claim:

1. A fuel nozzle guide assembly disposed between a planar bulkhead and a fuel nozzle insertable through an opening in the bulkhead, comprising:

a nozzle bushing disposed between the fuel nozzle and the bulkhead, the bushing fitting closely about the fuel nozzle and further defining an annular gap between the bushing and the bulkhead opening;

a heat shield, secured to one end of the bushing and extending outward therefrom parallel to the bulkhead and terminating at an outer edge beyond the bulkhead opening;

means, disposed between the heat shield and the bulkhead for spacing the heat shield from the bulkhead, the spacing means, bulkhead and heat shield further defining a plurality of flow paths for establishing fluid communication between the annular gap and the outer edge of the heat shield; and an annular retainer, disposed about the bushing opposite the heat shield with respect to the bulkhead and including a flat flange portion extending parallel to the bulkhead, the flat flange portion slidably contacting the bulkhead, the annular retainer further including an inner attachment ring closely fitting about and secured to the other end of the bushing, the retainer having a plurality of flow openings disposed therein adjacent the annular gap for admitting a flowing stream of cooling air directly into the gap.

2. The nozzle guide structure as recited in claim 1, wherein the spacing means includes a plurality of discrete standoffs, integral with the heat shield and extending toward the bulkhead.

3. The nozzle guide structure as recited in claim 1, further comprising means for preventing relative rotational movement between the nozzle guide structure and the bulkhead.

4. The nozzle guide structure as recited in claim 3, wherein the means for preventing relative rotational movement includes a post, secured to the planar bulkhead, and wherein the retainer includes a slot, disposed in the flange portion for receiving the post therein, the slot oriented for allowing transverse displacement between the bushing and the flange.

5. The nozzle guide structure as recited in claim 1, wherein the inner attachment ring is secured to the bushing by an annular weld bead disposed about the bushing.

6. The nozzle guide structure as recited in claim 1, wherein the annular retainer further comprises means for aligning the bushing with the fuel nozzle during insertion thereof.

7. The nozzle guide structure as recited in claim 6, wherein the aligning means includes a sloped tab, integral with the attachment ring and extending outwardly therefrom adjacent the nozzle bushing.

* * * * *